United States Patent [19]

Dodge, Jr.

[11] 4,234,324

[45] Nov. 18, 1980

[54] ELECTROSTATIC FILTER

[76] Inventor: Cleveland E. Dodge, Jr., Quarry Hill Farm, Pownal, Vt. 05261

[21] Appl. No.: 965,847

[22] Filed: Dec. 4, 1978

[51] Int. Cl.[3] ..... B03C 3/45

[52] U.S. Cl. ..... 55/156; 55/DIG. 5; 55/146

[58] Field of Search ..... 55/132, 142, 143, 141, 55/146, 154, 155, 156, DIG. 5, DIG. 38; 29/163.5 F; 156/210

[56] References Cited

U.S. PATENT DOCUMENTS

| | | | |
|---|---|---|---|
| 2,565,458 | 8/1951 | Weisz | 55/142 |
| 2,650,672 | 9/1953 | Barr et al. | 55/142 |
| 3,020,977 | 2/1962 | Huppke et al. | 156/210 |
| 3,416,540 | 12/1968 | Lidums | 55/142 |
| 3,698,977 | 10/1972 | Susuki et al. | 156/210 |
| 3,972,763 | 8/1976 | Wolvin et al. | 156/210 |
| 3,998,611 | 12/1976 | Honacker | 55/154 |
| 4,077,785 | 3/1978 | Hartshorn | 55/155 |

FOREIGN PATENT DOCUMENTS

| | | | |
|---|---|---|---|
| 600967 | 7/1960 | Canada | 55/142 |
| 1095098 | 12/1960 | Fed. Rep. of Germany | 156/210 |
| 2302083 | 7/1974 | Fed. Rep. of Germany | 156/210 |
| 2427759 | 1/1976 | Fed. Rep. of Germany | 55/142 |
| 1246520 | 9/1971 | United Kingdom | 55/141 |
| 1436826 | 5/1976 | United Kingdom | 55/154 |

*Primary Examiner*—David L. Lacey

*Attorney, Agent, or Firm*—Anthony H. Handal

[57] ABSTRACT

An electrostatic air filter comprising a first planar electrode, having planar surfaces, which is positioned, configured and dimensioned in such a manner that portions of a planar surface of the first planar electrode face other portions of its planar surfaces. A second planar electrode, also having planar surfaces, is positioned, configured and dimensioned to be supported between the facing planar surfaces of the first planar electrode with portions of its planar surfaces in facing relationship to facing portions of the first planar electrode.

1 Claim, 11 Drawing Figures

ELECTROSTATIC FILTER

BACKGROUND OF THE INVENTION

While modern industrial techniques have made significant progress towards reducing artificial air pollution, the mounting evidence of a definite connection between air pollution and a number of serious diseases has resulted in increased public concern with the problem. In addition to artificial and man-made pollution, the air in many parts of the world is often contaminated with pollen and other naturally occuring particulate pollutants. For many people, these particles cause a variety of allergic reactions ranging from discomfort to interference with breathing and other vital functions.

Accordingly, a great deal of work has been expended in developing practical systems for removing particulate pollutants from the air. The most efficient of these systems generally have two separate stages. The first stage consists of an emitter which charges the particles to be removed, while the second stage comprises means for accumulating the charged particles.

In emitter/accumulator systems, the emitter is made of a conductive material with a large surface area, such as steel wool, or any other suitable structure. Such structures must also offer a relatively low resistance to the passage of air. During operation, the emitter is connected to the negative side of a high-voltage source. The first step in the process of filtering is driving the air to be filtered through the emitter with a fan. This has the result of putting a negative charge on the $O_2$ molecules in the air. These $O_2$ molecules are, in turn, attracted to particles in the air, to which they adhere. The particles leaving the emitter thus have a net negative charge.

After passing through the emitter, the air with the charged particles entrained in it is passed through the actual filter stage where the charged particles are removed. The filter usually has a plurality of passages through which the air is passed, and structure for providing an electric field which extends transverse to the direction of air flow through the passages. Typically, the passages are defined between a pair of metal elements which are insulated from each other and connected to two opposite poles of the high-voltage power supply which drives the emitter. Thus, as the air is driven through the passages by the action of the fan, negatively charged particles entrained in the air tend to move toward the positive plate where they accumulate.

After the filter has been in operation for a period of time, it tends to become filled with accumulated particles. It then becomes necessary to either clean or replace the filter. Because the construction of such structures is relatively expensive, replacement is not economical and the filters are usually cleaned. This poses some practical problems inasmuch as the task of cleaning with water and chemicals requires some time and, because of the inconvenience involved, it is often neglected. Other problems with such systems include the high cost of high-voltage generating equipment and the attendant danger of electrical shock. Nevertheless, because these systems have efficiencies in the order of 95%, they are in widespread use.

Alternative structures also find very wide employment. One of the most commonly used systems is the passive fiberglass filter. These filters are made of a relatively dense mass of fiberglass or other fibrous material which is held within a cardboard support member. Particles are removed from the air by simply driving the air through the filter with a fan. The filter presents a tortuous path to the particles, which are caught and retained in the fiberglass. When these filters lose their effectiveness, they are discarded because of their low cost and replaced with a fresh filter. Still another advantage is the elimination of the need for high-voltage generation equipment.

The simplicity of its design renders the passive filter suitable for such widely diverse applications as home air conditioners and automobile air filters. However, passive filters usually have an efficiency of only three to five percent. Moreover, if one tries to improve on this efficiency, by increasing the density or thickness of the filter, the viscous resistance of the filter rises dramatically, causing the rate of air flow through the filter to drop below practical minimums.

As an alternative, it has also been noted that the second stage of the emitter/accumulator filtering system has an efficiency of about 85% when it is used without an emitter. This is due to the natural charge on particles in the air. However, this, as far as is known, has not been pursued as a practical alternative until very recently because of the fact that a high-voltage source is still needed and it makes sense to add the emitter for the gain in efficiency.

Recently, C. G. Kalt has shown that practical air filters with efficiencies comparable to that of the second stage of emitter/accumulator filters can be achieved when driving an accumulator with a low-voltage source, provided that the construction of the filter is modified. Specifically, Kalt's filters comprise a plurality of electrically conductive filter elements which are made of mylar having a deposit of aluminum on one or both of their surfaces. The mylar sheets are exceedingly thin, typically a thousandth of an inch in thickness with a millionth of an inch of metal deposited on them. These metalized mylar elements are arranged to form a relatively large number of narrow and relatively long passages. Although it is necessary to use a great many filter elements to make such a large number of passages, the thinness of the mylar, nevertheless, results in a very low air resistance. Moreover, because the passages are narrow, the voltage may be reduced to a value in the range of several hundred volts while still retaining effectiveness. Although particles passing through the filter are not accelerated very quickly toward the sides of the passages, the passages are narrow and a significant number accumulate on the surfaces of the passages. Moreover, the mylar is inexpensive and, it is contemplated that the filters would be discarded after use.

The present invention provides a method for making filters from metalized mylar or any other suitable thin conductive material. The method for making the filters and the machinery involved is economical, simple, and reliable. An additional advantage is that in accordance with the preferred embodiment, the final product may be circular in shape which results in an efficient use of material because the useful area of many planar air filters matches the circular shape of the fan which blows air through them.

SUMMARY OF THE INVENTION

In accordance with the present invention, a method of making an air filter comprises forming a first planar electrode into a predetermined form. Simultaneously, a second planar electrode is placed into a position and formed into a configuration where it is in facing relationship to the first planar electrode. Also simultaneously, a spacer is positioned between the first planar electrode and the second planar electrode.

The inventive filter comprises a first planar electrode, having planar surfaces, which is positioned, configured and dimensioned in such a manner that portions of the planar surface of the first planar electrode face other portions of its planar surfaces. A second planar electrode, also having planar surfaces, is positioned, configured and dimensioned to be supported between the facing planar surfaces of the first planar electrode with portions of its planar surfaces in facing relationship to facing portions of the first planar electrode.

DETAILED DESCRIPTION OF THE PREFERRED EMBODIMENTS

Figures 1, 2, 3, 4, 5, 6, 7, 8, 9, 10, 11:
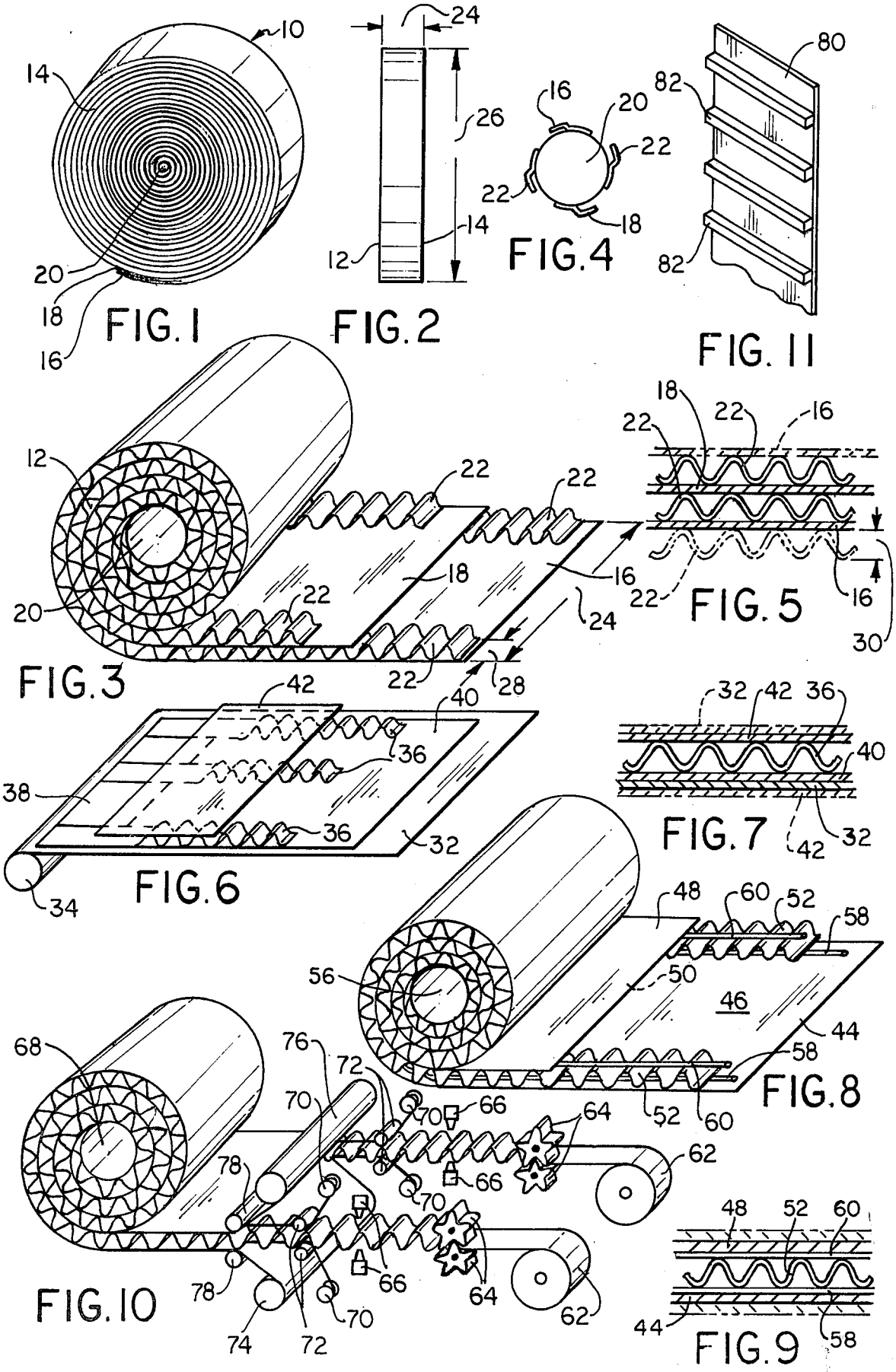
FIG. 1 is a perspective view of an air filter constructed in accordance with the present invention.
FIG. 2 is a side elevational view of the inventive air filter.
FIG. 3 is a perspective view in detail of the central portion of an air filter constructed in accordance with the present invention showing the structural configuration of the various components of the air filter when it is partially unwound.
FIG. 4 is a yet more detailed view of a portion of the air filter illustrated in FIG. 3 showing the connection of the elements to the core.
FIG. 5 is a schematic view of a portion of an air filter such as that illustrated in FIG. 3.
FIG. 6 is a perspective view illustrating the structure of an alternative air filter constructed in accordance with the present invention.
FIG. 7 is a schematic illustration of a portion of the air filter whose construction is illustrated in FIG. 6.
FIG. 8 is a perspective view illustrating yet another air filter constructed in accordance with the present invention.
FIG. 9 is a schematic view in detail of a portion of the air filter whose construction is illustrated in FIG. 8.
FIG. 10 is a schematic illustration of an apparatus for manufacturing an air filter such as that illustrated in FIG. 8.
FIG. 11 illustrates an alternative spacer structure for incorporation into filters constructed in accordance with the present invention.

A filter 10 constructed in accordance with the present invention is illustrated in FIGS. 1 and 2. Filter 10 includes an input face 12 and an output face 14. As illustrated in FIG. 3, the filter is constructed by winding a pair of long planar conducting members, which serve as an anode and a cathode, together with appropriate spacer structure around a central mandrel. In particular, the filter comprises a spiral-shaped anode 16 and a spiral-shaped cathode 18. The anode and cathode are connected to a central mandrel 20, as is illustrated most clearly in FIG. 4. The anode and cathode are spaced from each other by spacers 22 which are also secured to mandrel 20. Any suitable means, such as glue may be used to secure the anode, the cathode, and the spacers to mandrel 20.

Anode 16 and cathode 18 are made of any thin planar conductive material. Suitable materials include metalized mylar and metallic foil. Spacers 22 may be made of any suitable nonconductive material such as cardboard, paper reinforced with a layer of supportive material, plastic, textile, etc. It has been found particularly advantageous to make spacers 22 of cardboard or relatively thick paper because of the inexpensive nature of these materials. It has also been founded advantageous to coat the cardboard with glue during formation of the filter, as will be described below, inasmuch as the glue does double-duty by making the cardboard or paper a more formidable support while at the same time binding all the parts of the filter to each other. The mandrel may be a cardboard tube, a plastic tube or any other suitable support. In the event that a cardboard tube is used it may also be desirable to close the end of the tube with a plug in order to prevent a flow of unfiltered air.

The thickness 24 of the filter in the direction of air flow, depending upon the application for which the filter is to be used, ranges between a fraction of an inch to several feet. Likewise, the diameter 26 of the filter 10 may range from a fraction of an inch to many feet in diameter. Generally, spacers 22 are made of a thicker and stronger material than the anode and cathode because of their supportive function. The anode and cathode may vary in thickness between 0.00025 and 0.1 inches. Naturally, the width 28 of the spacers should only be a small fraction of the width 24 of the filter. This is due to the fact that the presence of the spacer substantially impedes proper operation of the filter. As illustrated in FIG. 5, the thickness 30 of the spacer will determine the distance between anode 16 and cathode 18. Generally, one would seek to maintain a minimum amount of spacing between the anode and the cathode, inasmuch as this has the effect of increasing the strength of the electric field extending between the anode and the cathode and reducing the transverse path which a particle follows on its way toward the sidewall of the passage defined between the anode and the cathode. However, care must be taken to be certain that the thickness 30 of the spacer is not so small as to create a possibility that the anode is brought into electrical contact with the cathode. Alternatively, it may be desirable to spray the surfaces of the anode and the cathode with a thin layer of a nonconducting material. A filter, such as that illustrated in FIGS. 1–5 for use in a home air conditioning apparatus typically has a thickness 24 of about three inches. Its diameter 26 is in the order of about sixteen inches. Spacers 22 have a width 28 of one-quarter of one inch and are made of a heavy paper or light cardboard. The spacers 22 are sprayed with glue thereby securing the anode to the cathode and insuring the structural integrity of the filter. The thickness 30 of the spacers is in the range of one-sixteenth of an inch. The anode, cathode and spacers are secured to a paper tube as illustrated in FIG. 4 and rolled as illustrated in FIG. 3 until a filter with the desired diameter has been formed. The paper mandrel 20 is plugged on both ends. The anode and cathode are then connected to conductors which allow the filter to be connected to a source of power. The finished filter is then mounted in a cardboard or plastic frame.

During operation a voltage is placed between the anode and the cathode. With a passage equal in length to thickness 24 and a distance between the anode and cathode equal to thickness 30, a voltage in the order of several hundred volts has been found to be effective in removing particles from the air when a conventional air conditioner fan is used to blow air through the filter. This voltage can most inexpensively and effectively be obtained by connecting the a.c. line to a solid-state voltage tripler.

It is also noted that without affecting the efficiency of the air filter in removing particles from the air, the various physical parameters of the filter may be varied. For example, reducing the spacing will increase effectiveness, as will increasing the voltage.

The inventive filter may also be formed in a number of alternative ways. For example, the filter may be made by winding an insulator sheet 32 around a mandrel 34 to which it is secured, as is illustrated in FIG. 6. In this embodiment three cardboard spacers 36 are secured to an insulator tongue 38 which is, in turn, secured to insulator sheet 32. A metalic foil anode 40 is secured between insulator 38 and insulator 32. Likewise, a cathode 42 is secured to the other side of insulator 38.

Essentially, this embodiment of the invention functions according to the same principles as the filter illustrated in FIGS. 1–5. However, the filter of FIG. 6 includes a third spacer 36 because its thickness is greater than thickness 24 of the embodiment illustrated in FIG. 1. Additionally, instead of having two sets of spacers to serve as insulators between the anode and the cathode, this embodiment includes one set of spacers 36 and an insulator sheet 32.

The resulting air passage between anode 40 and cathode 42 is illustrated schematically in FIG. 7. Contact between the anode 40 and cathode 42 is prevented by insulator 32 on one side of cathode 42 and by spacers 36 on the other side of cathode 42.

Yet another embodiment of the invention is illustrated in FIG. 8. In accordance with this embodiment, the anode 44 comprises mylar with a thin metal layer 46 deposited on it. Likewise, the cathode 48 comprises mylar with a thin layer 50 of metal deposited on it. Layers 46 and 50 thus face each other and are separated from each other by a pair of spacers 52. Both the anode and the cathode together with spacers 52 are wound on a cardboard mandrel 56.

An advantage of metalized mylar is the fact that the resulting filter is self-healing. In the event that the anode should come into contact with the cathode, or more specifically in the event that conductive layer 46 should come into contact with conductive layer 50 (which is separated from it only by the spacer structure), the resulting short will burn out the metal layers 46 and 50 in the area of the short until there is no longer a path for electricity to flow. The filter will then resume normal operation.

It has also been found desirable to insure a good connection to all parts of the filter by incorporating anode wires 58 between the anode and the spacers and cathode wires 60 between the cathode and the spacers. Anode wires are connected to each other and to a source of positive potential during operation of the filter, while cathode wires 60 are connected to the negative side of the source of voltage. Alternatively, one may desire only to use one anode wire and one cathode wire. In the event that a short should burn out part of the metal coating, electrical potential will be brought to the anode and cathode by the wires 58 and 60.

FIG. 10 is a schematic illustration of an apparatus for manufacturing the air filter illustrated in FIG. 8. The apparatus comprises a pair of spacer ribbon feeding spools 62 which feed a spacer ribbon between respective pairs of spacer corrugators 64, which are driven by sources of rotary power to form the ribbon into a corrugated form. The corrugated spacer ribbon is then coated with glue by being passed between facing pairs of spray nozzles 66. The sprayed spacer is then sent to be wound around a mandrel 68 which is rotated in synchronism with corrugators 64. Four threads of uninsulated fine copper wire are fed simultaneously from four spools 70 and guided by rotary mounted mandrels 72. Simultaneously, as mandrel 68 is rotated, the anode and cathode are formed from rolls of metalized mylar 74 and 76. The mylar is guided by idlers 78, which guide it into contact with the spacer to which it is secured.

In FIG. 11, an alternative spacer structure to the corrugated ribbon is illustrated. It comprises a ribbon 80 of paper or other material to which spacer elements 82 are secured. Alternative spacers include glass beads, twisted paper or paper with dimples punched in it.

In order to achieve an alternative driving arrangement, the cathode may be displaced axially with respect to the anode. This would cause a peripheral edge of the anode to extend beyond one face of the filter and a peripheral edge of the cathode to extend beyond the other face. A contacting rod could then be passed through the extending portion of each of the electrodes. Because the electrodes are spiral-shaped, the contacting rod would pass through and be connected to its respective electrode at a plurality of points. The contacting rod could then be attached to a voltage source to provide the necessary potential between the anode and cathode.

While several illustrative embodiments of the invention are described, it is, of course, understood that various modifications will be obvious to one of ordinary skill in the art. For example, the metalized mylar used to achieve self-healing generally has a coating of aluminium having a thickness of a millionth of an inch, and a resistance of one ohm per square inch. Alternatively, a layer of other conductive material, such as low melt metal, could also be used. It is only necessary that the layer have a current carrying capacity less than the current which will result when the anode is short-circuited to the cathode. This will cause the electrodes to burn out in the area of the short. Naturally, the lesser the current carrying capacity of the layer, the smaller the area. The size of the burned-out area is about the same order of magnitude as the width of a strip of the layer having a current carrying capacity equal to the short-circuit current. Also, in the preferred embodiment, elements of the filter are often secured to the mandrel directly. Other securing means may be used such as having one element connected to the mandrel and the other elements connected to it. The spacer structure may also be varied. For example, one could wind an open weave cloth between the layers of conductors. The cloth could extend the entire length of the filter or only comprise ribbon strips similar to ribbon 80. Such modifications are within the spirit and scope of the invention which is limited and defined only by the appended claims.

What is claimed is:

1. A filter, comprising:

(a) a first planar electrode made of a very thin sheet of resinous material with a much thinner layer of conductor deposited thereon and having a length much longer than its width and having planar surfaces and positioned, curvedly configured and dimensioned in such a manner that portions of a planar surface of said first planar electrode face other portions of its planar surfaces;

(b) a second planar electrode made of a very thin sheet of resinous material with a much thinner layer of conductor deposited thereon and having a length much longer than its width and having planar surfaces positioned, curvedly configured and dimensioned to be supported between said facing portions of said planar surfaces of said first planar electrode with portions of its planar surfaces in facing relationship to facing portions of said first planar electrode to define a plurality of paths parallel to the width of said first and second planar electrodes; and (c) spacer means secured to said first planar electrode to make portions of said first planar electrode substantially rigid with respect to other portions of said first planar electrode and for substantially rigidly securing points on said second planar electrode to said first planar electrode said spacer means comprising a pair of resilient insulative ribbons having a width much less than the width of said planar electrodes which have been corrugated and which are adhered to said first and second planar electrodes.

* * * * *